US006364815B1

(12) United States Patent
Lapcevic

(10) Patent No.: US 6,364,815 B1
(45) **Date of Patent: *Apr. 2, 2002**

(54) MULTIPLE TORQUE ARM EXERCISE DEVICE

(76) Inventor: Thomas G. Lapcevic, 32 White Birch Cir., Pittsburgh, PA (US) 15220

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/609,244

(22) Filed: Mar. 1, 1996

(51) Int. Cl.[7] ..... A63B 21/08
(52) U.S. Cl. ..... 482/97; 482/100; 482/137
(58) Field of Search ..... 482/92–94, 97–100, 482/136, 137, 908, 135, 138; 74/89.2, 89.22; D21/673, 675, 676

(56) References Cited

U.S. PATENT DOCUMENTS 1,062,385 A * 5/1913 Campbell ..... 74/89.22
2,225,845 A * 12/1940 Richolt ..... 74/89.21
2,855,199 A * 10/1958 Noland et al. ..... 482/97
3,088,449 A * 5/1963 Hockaday et al. ..... 74/89.22
3,306,611 A * 2/1967 Gaul ..... 482/100
3,856,297 A * 12/1974 Schnell ..... 482/97
4,322,071 A * 3/1982 Lambert, Jr. et al. ..... 482/100
4,353,262 A * 10/1982 Talbot ..... 74/89.2
4,405,128 A * 9/1983 McLaughlin et al. ..... 482/97
4,494,751 A * 1/1985 Schnell ..... 482/136
4,502,681 A * 3/1985 Blomqvist ..... 482/130
4,799,670 A * 1/1989 Williamson ..... 482/97
4,834,396 A * 5/1989 Schnell ..... 482/97
4,854,578 A * 8/1989 Fulks ..... 482/100
4,930,768 A * 6/1990 Lapcevic ..... 482/100
5,039,089 A * 8/1991 Lapcevic ..... 482/97
5,058,884 A * 10/1991 Fuller, Sr. ..... 482/97
5,088,726 A * 2/1992 Lapcevic ..... 482/97
5,286,243 A * 2/1994 Lapcevic ..... 482/97

* cited by examiner

*Primary Examiner*—Mickey Yu
*Assistant Examiner*—Victor K. Hwang
(74) *Attorney, Agent, or Firm*—Webb Ziesenheim Logsdon Orkin & Hanson, P.C.

(57) ABSTRACT

The present invention provides an exercise device in which resistance curves can be selectively varied and controlled to achieve a desired positive resistance curve notwithstanding the degree of rotation of the exercise motion. Generally, the exercise device of the present invention comprises a support frame upon which a first shaft is rotatably supported. A user interface member (or exercise member) is connected to the first shaft such that when the user interface member is displaced by a user the first shaft is caused to rotate. A second shaft is also rotatably supported on the support frame. A torque arm assembly comprising of a plurality of torque arms is connected to the second shaft. Each of the plurality of torque arm is adapted to support a weight member thereon. A conversion mechanism connects the first and the second shafts to limit the degree of rotation of the second shaft in such a manner that the resistance generated by the torque arm assembly cannot result in a negative resistance force.

10 Claims, 5 Drawing Sheets

MULTIPLE TORQUE ARM EXERCISE DEVICE

FIELD OF THE INVENTION

The present invention relates to exercise devices used on the human body and, more particularly, to exercise devices wherein the resistance curve experienced by the human body can be selectively and easily adjusted.

BACKGROUND OF THE INVENTION

As discussed in some detail in U.S. Pat. No. 5,286,243, most exercise devices provide only a single resistance curve that cannot be altered to conform to individual requirements. A number of exercise devices enable resistance curves to be varied, but only with severe practical and functional limitations.

In the exercise device of U.S. Pat. No. 2,855,199, for example, the resistance can be varied through the range of motion of an exercise by selectively adjusting the radial position of a weight arm upon which a weight member is affixed. Through the relative placement of the weight arm with respect to the exercise arm, different resistance curves can be experienced during the course of the exercise motion. That device, however, has inherent limitations that make its practical application severely limited. Moreover, those limitations can be dangerous in an uncontrolled setting.

For example, because the degree of rotation of the weight arm is equivalent to that of the exercise or leg arm of that device, the sinusoidal resistance force generated by the weight arm is directly correlated to (that is, having a one-to-one correlation with) the degree of rotation of the exercise arm. Such direct correlation results in several substantial limitations. Seldom if ever is a desired sinusoidal resistance curve achieved through a direct correlation between the rotation of the exercise arm and the rotation of the weight arm, especially in a situation where the radial position of the weight arm is being varied. To illustrate, if the weight arm is set to place maximum overload at the beginning of the motion, and the exercise arm is rotated more than 90 degrees, the weight arm will generate negative resistance during the end of the exercise motion. A resistance force that suddenly changes from a positive resistance force to a negative resistance force may cause the user to lose control of the exercise arm, resulting in a substantial risk of injury. Moreover, when negative resistance occurs in the device of U.S. Pat. No. 2,855,199, the user must cease the exercise until the exercise arm is brought back to the starting position. Additionally, a negative resistance force is clearly undesirable for strength conditioning. Finally, a resistance curve that either decreases or increases too rapidly, whether or not it results in a negative resistance force, leads to an awkward exercise motion and less than optimal training.

The device of U.S. Pat. No. 2,855,199 is further limited by providing only a single sinusoidal resistance force via the single weight arm thereof. Even absent the concerns of negative resistance, an excessive, or a too rapidly changing resistance, less than optimal control over the resistance forces results from the single sinusoidal pattern. Often, the desired resistance curve for a particular exercise motion for a specific individual is something other than a simple sinusoidal resistance curve. It is, therefore, highly desirable to enable manipulation of the rate of change of the pattern of the resistance curve. Such manipulation is impossible with a single weight arm.

Furthermore, because the variance of the force is achieved by altering the radial position of the weight in the device of U.S. Pat. No. 2,855,199, to alter the resistance force the user must either unload the weight arm and then rotate it or attempt to rotate a loaded weight arm. In the former case, the user is substantially inconvenienced. In the latter case, the user is risking serious injury. Additionally, a linkage for connecting a weight arm at different radial positions is quite expensive and generally leads to a loose connection point.

U.S. Pat. No. 4,405,128 disclosed an exercise device comprising multiple torque arms designed to enhance or off-set the weight of the human body as an individual performs a sit-up exercise. Through off-setting body weight, the invention is intended, in part, to assist weak persons in performing sit-ups. The invention thus has the inherent requirement of generating negative resistance forces to counter-balance the user's body weight. Additionally, the degree of rotation of the torque arms and the degree of rotation of the chest engaging means are required to correlate on a one-to-one basis. Otherwise the desired counter-balancing would not be achieved. While such operation may be desirable for a sit-up device seeking to counter-balance and add resistance to the body-weight of the user, the negative resistance generated by the torque arms and the direct correlation between the rotation of the torque arms and that of the chest engaging means results in the same inherent limitations discussed above in connection with U.S. Pat. No. 2,855,199.

Very recently, a number of advances have been made in the exercise arts. U.S. Pat. No. 5,286,243, for example, discloses an exercise device combining the resistance generated by a plurality of torque arms with a conversion mechanism that creates a greater degree of rotation of the torque arms than that of the exercise arm. It is possible, through proper relative placement of weights along designated torque arms, to achieve desirable resistance curves. However, both positive and negative resistance forces are achievable during the exercise motion. Consistently maintaining a desired resistance curve and consistently maintaining a positive resistance load throughout the exercise motion requires proper adjustment of numerous torque arm variables. The proper adjustment of such variables may in many cases be beyond the patience and/or the knowledge of the average exercise equipment user.

It is desirable to develop an exercise device that overcomes the limitations of current exercise devices. It is particularly desirable to develop an exercise device that provides a plurality of resistance curves, but will not result in a resistance curve that changes too rapidly or results in a negative resistance force.

SUMMARY OF THE INVENTION

The present invention provides an exercise device in which resistance curves can be selectively varied and controlled to achieve a desired positive resistance curve notwithstanding the degree of rotation of the exercise motion. The present invention utilizes a unique torque arm assembly that preferably comprises a plurality of torque arms positioned at different radial positions such that the relevant placement of weight members on the torque arms results in an endless array of resistance curves. In any such resistance curve, the present invention continuously maintains a positive resistance force regardless of the manner of loading of the torque arms.

Generally, the exercise device of the present invention comprises a support frame upon which a first shaft is rotatably supported. A user interface member (or exercise member) is connected to the first shaft such that when the user interface member is displaced by a user the first shaft is caused to rotate. A second shaft is also rotatably supported on the support frame. A torque arm assembly comprising of a plurality of torque arms is connected to the second shaft. Each of the plurality of torque arms is adapted to support a weight member thereon. In one embodiment, an independent weight member on each of the plurality of torque arms is linearly positionable on each of the plurality of torque arms. A conversion mechanism connects the first and the second shafts to control the degree of rotation of the second shaft in such a manner that the resistance generated by the torque arm assembly cannot result in a negative resistance force. In preventing a negative resistance force, the conversion mechanism may either limit or magnify the rotation of the second shaft, provided that in no case is the rotation of the second shaft sufficient to create a negative resistance force.

The support frame is preferably free standing and preferably comprises interconnected vertical and horizontal framework members. The conversion mechanism preferably comprises a beltwheel assembly. The beltwheel assembly preferably comprises a first beltwheel attached to the first shaft and a second beltwheel attached to the second shaft. The rotation of the first beltwheel and the second beltwheel is correlated via a belt. One end of the belt is connected to the second beltwheel. The belt is then wrapped around a portion of the first beltwheel and connected at its other end to the second beltwheel. Preferably, a connector pinches the belt to the first beltwheel such that the rotation of the first beltwheel causes the rotation of the second beltwheel without having the belt slip. A conversion mechanism is thereby achieved between the first and second shafts in which the degree of conversion (that is, the change in the degree of rotation) is a function of the relative sizes (diameters) of the first and second beltwheels. A similar conversion can be achieved through other means. For example differently sized rotating members can be used in the form of meshing spur gears or in the form of a gear-and-chain assembly. However, such other conversion mechanisms generally do not provide as smooth an exercise motion as a beltwheel assembly and/or generally increase costs.

The size ratio between the first and second beltwheels is preferably selected so that the maximum degree of rotation applied to the first shaft by the exercise motion of the user is converted to no more than approximately 90 degrees of rotation on the second shaft. More preferably, the maximum degree of rotation applied to the first shaft is converted to no more than approximately 70 degrees of rotation of the second shaft.

A fastening means is preferably provided for attaching the torque arm assembly to the second shaft. Preferably, as illustrated in FIGS. 1 through 6, the torque arms extend radially from a common center. Preferably, the angle between the outermost torque arms is no more than 90 degrees. Preferably, the torque arm assembly comprises three torque arms wherein the angle between each torque arm is approximately thirty-five (35) degrees. In that embodiment the angle between the outermost torque arms is approximately 70 degrees.

The torque arm assembly is preferably positioned such that the upper torque arm applies a maximum resistance force to the second shaft (and consequently to the first shaft) when the exercise member is in its initial or starting position. Thus, the upper torque arm is preferably located at either the 3 o'clock position or the 9 o'clock position depending upon the direction of rotation. Since the conversion mechanism preferably assures that the second shaft will rotate no more than 90 degrees (and, more preferably, no more that 70 degrees), the torque assembly will never generate a negative resistance force regardless of the manner of the loading of the torque arms by the user.

A means for securing at least one weight member is affixed to each torque arm. In its simplest form, this weight securing means comprises a peg upon which weight plates can be held. It is also possible to have weight members slide along the torque arms to selected positions to create an adjustable resistance force that does not require the removal of the weight members.

In the operation of the present invention, each weight member supported on a torque arm provides a resistance force that follows a sinusoidal curve. If a single torque arm is loaded, the force generated will follow the sinusoidal curve associated with that torque arm. Should more than one torque arm be loaded, the force generated will follow the vector summation of the sinusoidal curves associated with each of the torque arms that are loaded. Thus, the torque assembly permits the user to vary the overall resistance force depending upon the relative placement of weight members on the torque arms.

As discussed above, the conversion mechanism assures that the torque assembly attached to the second shaft rotates the proper degree of rotation regardless of the degree of rotation of the exercise member attached to the first shaft. To determine an appropriate ratio between the first and second beltwheels for any given exercise unit and its associated exercise motion, the degree of rotation of the exercise motion is determined and the ratio between the first and second beltwheels is set accordingly.

For example, assuming that the average exercise motion is 140 degrees, placing a 6-inch beltwheel on the first shaft and a 12-inch beltwheel on the second shaft will result in a desirable 70 degrees of rotation of the second shaft. Further assuming that a counter-clockwise rotation of the second shaft occurs when the first shaft is rotated during the course of the exercise motion, the starting position of the torque assembly is preferably located such that the upper torque arm is located at approximately 3 o'clock (that is, horizontally). In a preferred embodiment, the second torque arm is approximately 35 degrees toward 6 o'clock from the first torque arm, and the third torque arm is approximately 35 degrees toward 6 o'clock from the second torque arm. The positioning of the torque arm assembly in this manner together with the 2:1 ratio between the first and second shafts assures that the user will always experience a positive resistance force during the course of the exercise motion, regardless of the manner in which the torque arms are loaded.

By varying the relative loading of the torque arms an indefinite number of resistance curves can be achieved. The use of a plurality of torque arms is thus a substantial improvement over the case of a single torque arm in which only a single sinusoidal resistance curve is attainable. To illustrate, and using the above-described example of a torque assembly of the present invention comprising three torque arms, assuming the user desires to overload the beginning of the exercise motion, the user loads the upper torque arm (that is, the torque arm at the 3 o'clock position). This loading results in the user experiencing 100% of the resistance at the beginning of the motion and approximately 34% at the end of the motion. If the user wants to overload the middle of the motion, the user loads the middle torque arm. This loading results in the user experiencing 82% of the resistance at the beginning of the motion, 100% of the resistance in the middle of the motion and 82% at the end of the motion. To overload the end of the motion the user loads the lower torque arm. This loading results in the user experiencing 34% of the resistance at the beginning of the motion and 100% of the resistance at the end of the motion. FIGS. 2*a* through 2*c* shows the beginning, middle and end positions of the three torque arms during the course of an exercise motion assuming that the torque arms have been converted to rotate 70 degrees during the course of the exercise motion.

By loading more than one arm, for example the upper torque arm and the middle torque arm, the user will experience the vector sum effect of the sinusoidal curves generated by the upper and middle torque arms. Thus, the user will experience maximum resistance somewhere between the beginning and the middle of the motion, depending upon the relative ratios of the weights on the two torque arms. A middle to end overload would occur if the middle and lower torque arms were each loaded.

The present invention thus provides incredible variability while never allowing the user to experience the risks associated with negative loading. The combination of the conversion mechanism of the present invention with a properly positioned torque assembly having multiple torque arms conveniently, simply and safely enables satisfaction of the resistance pattern needs of any user.

Other details, objects and advantages of the present invention will become apparent as the following detailed description of preferred embodiments of practicing the invention proceeds.

DETAILED DESCRIPTION

Figure 3:
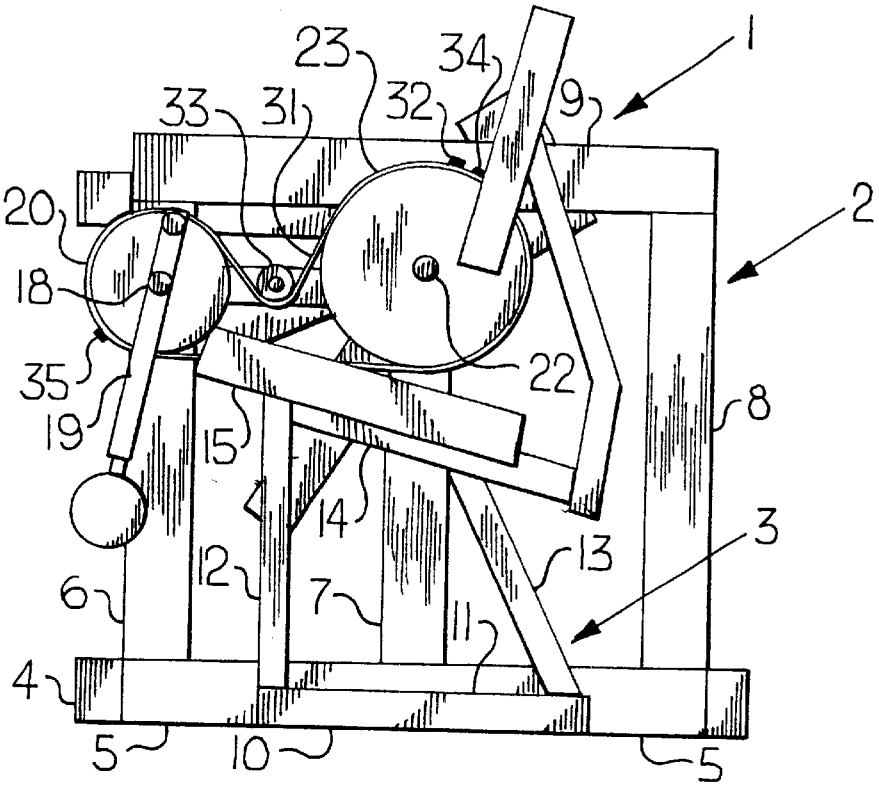
FIG. 3 is a side elevation view of a leg exercise device of the present invention.
Figure 4:
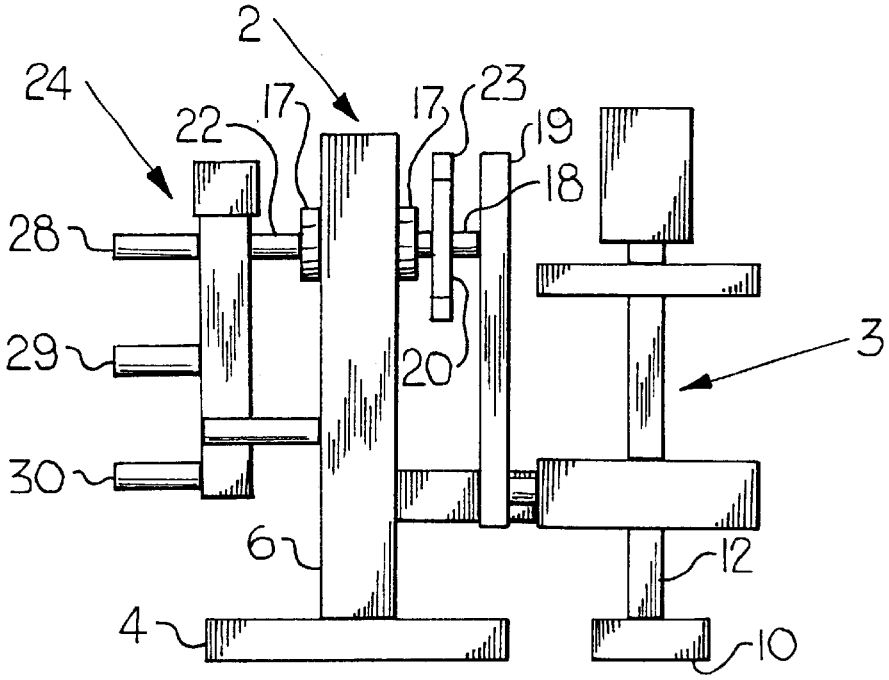
FIG. 4 is a front elevation view of the embodiment of FIG. 3.
Figure 5:
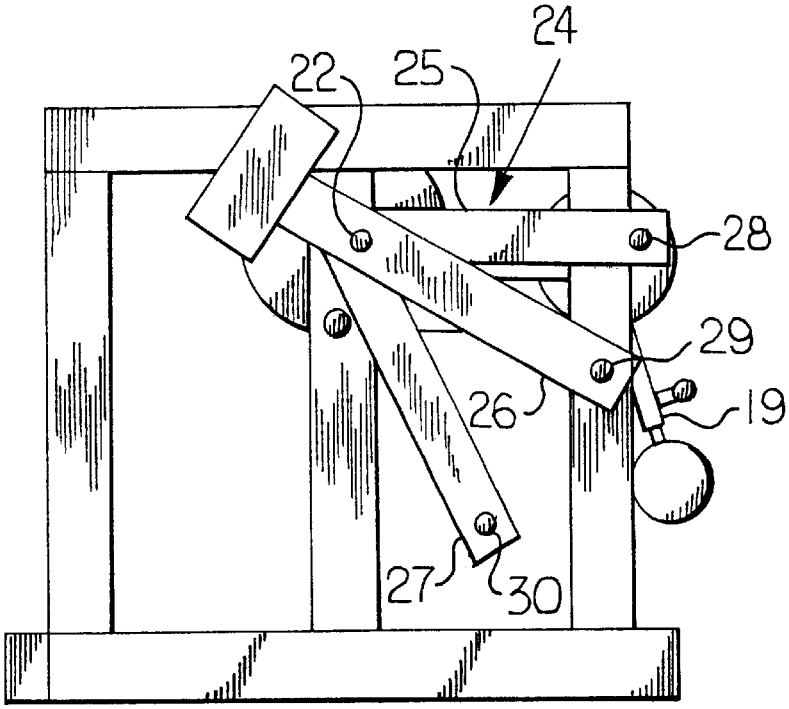
FIG. 5 is a side elevation view of the embodiment of FIG. 3, viewed from the opposite side of FIG. 3.

Referring now to the drawings wherein preferred embodiments of the present invention are shown for illustrative purposes only and not for the purposes of limiting the same. FIGS. 3 through 5 show a weight lifting exercise device 1 having an exercise frame 3 which may be occupied by a user. Exercise device 1 preferably includes a power frame 2 as well as exercise frame 3. Power frame 2 preferably comprises lateral base frame members 4 and longitudinal frame members 5 suitable for support on a floor surface. Power frame 2 also preferably includes parallel forward, middle and rear vertical frame members 6, 7 and 8, respectively, which support an upper longitudinal frame member 9. Exercise frame 3 also preferably comprises lateral base frame members 10 and longitudinal frame members 11 suitable for support on a floor surface. Exercise frame 3 further preferably includes parallel forward and rear vertical frame members 12 and 13, respectively, which support an upper longitudinal frame member 14 and a seat member 15. Power frame 2 and exercise frame 3 are preferably connected by lateral base cross-support members 16.

Figure 1:
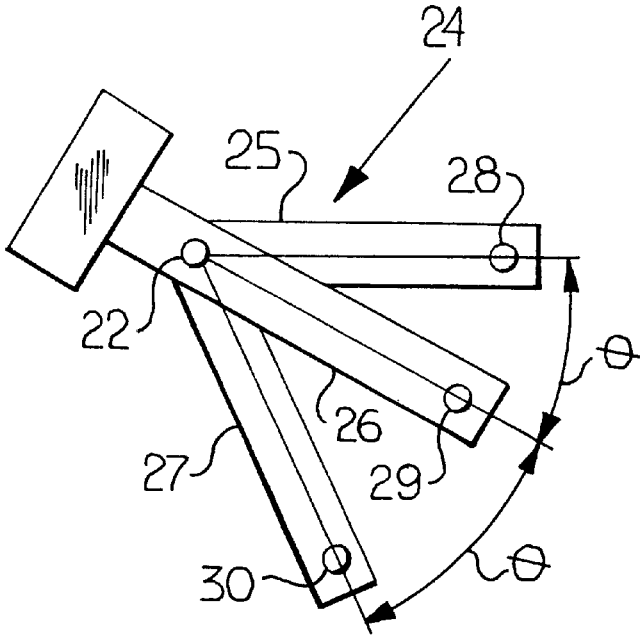
FIG. 1 shows an embodiment of a torque assembly comprising three torque arms wherein the torque arms are placed at predetermined angular positions with respect to each other; specifically, the angle between adjacent torque arms is approximately 35 degrees.
Figure 2A:
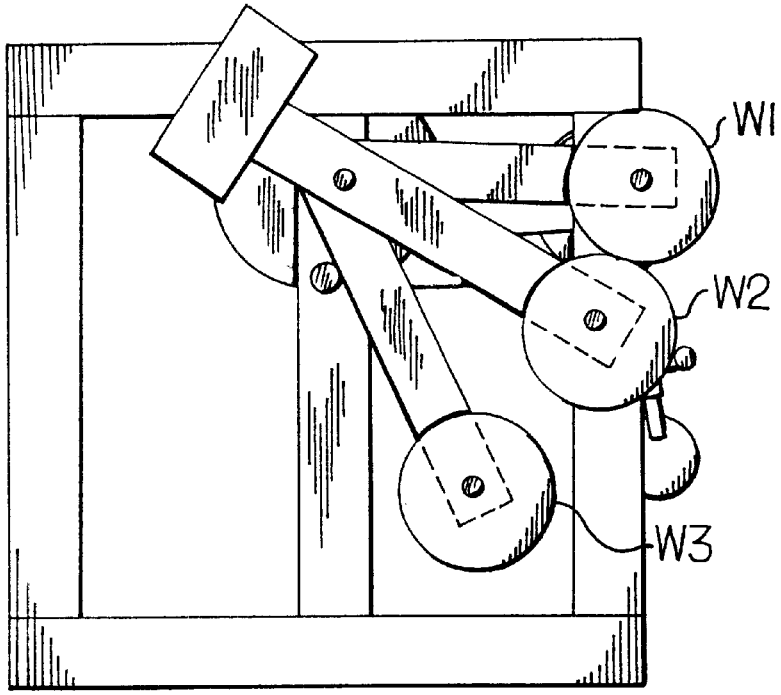
FIG. 2*a* shows a preferred position of the three torque arms of FIG. 1 at the beginning of the exercise motion, with weight members W1, W2 and W3 supported on the three torque arms.
Figure 2B:
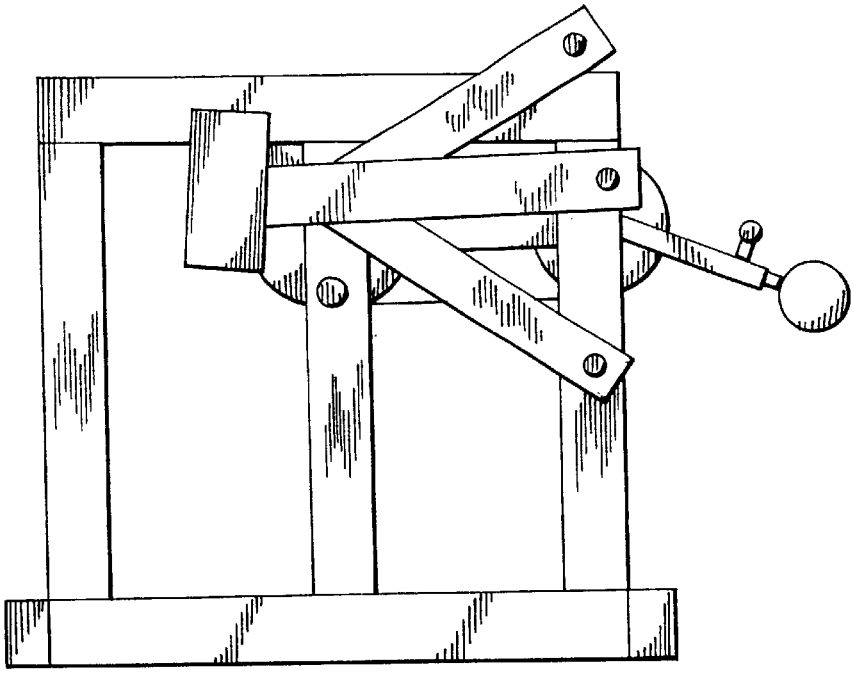
FIG. 2*b* shows a preferred position of the three torque arms of FIG. 1*a* at the middle of the exercise motion.
Figure 2C:
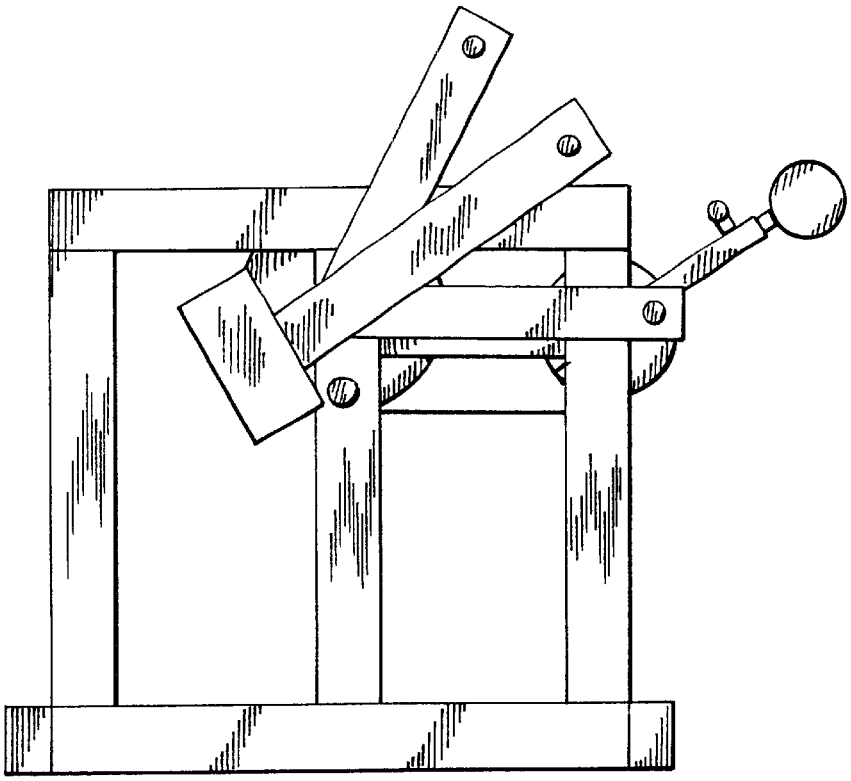
FIG. 2*c* shows a preferred position of the three torque arms of FIG. 1*a* at the end of the exercise motion.

Power frame 2 supports a first set of side mounted flange bearings 17 flanked on either side of front vertical frame member 6. Rotatably supported by first set of flange bearings 17 is a first horizontal rotatable shaft 18. Radially attached to first rotatable shaft 18 is a bracket which supports an exercise member 19 which is engaged by the user during the exercise motion. Also attached to first rotatable shaft 18 is a first beltwheel 20 positioned between exercise member 19 and front vertical frame member 6. Power frame 2 also supports a second set of side mounted flange bearings 21 flanked on either side of middle vertical frame member 7. Rotatably supported by second set of flange bearings 21 is a second horizontal rotatable shaft 22. Attached to second rotatable shaft 22 is a second beltwheel 23 positioned on the same side of middle vertical frame member 7 and in substantially longitudinal alignment with first beltwheel 20. Also attached to second rotatable shaft 22 but on the side opposite second beltwheel 23 is a torque arm assembly 24, preferably comprising three torque arms 25, 26 and 27 with an angle θ (preferably at least approximately 20 degrees, and, more preferably, approximately 35 degrees) between each torque arm (see FIG. 1). Although torque arm assembly 24 is depicted as comprising three torque arms 25, 26 and 27, it can comprise two torque arms or more than three torque arms. Likewise, angle θ need not be constant. Angle θ between adjacent torque arms is preferably at least 20 degrees to provide an easily noticeable resistance curve difference when adjacent torque arms are differently loaded. Secured to each torque arms 25, 26 and 27 are preferably weight pegs 28, 29 and 30 extending outward upon which weight members (not shown) can be removably secured.

Torque arm assembly 24 is preferably positioned in relation to second beltwheel 23 and exercise member 19 such that upper torque arm 25 is positioned to generate the greatest amount of resistance at the beginning of the exercise motion with remaining torque arms 26 and 27 being positioned toward the 6 o'clock position relative to upper torque arm 25. In such a preferred embodiment, the location of upper torque arm 25 is at the 3 o'clock position with the remaining torque arms 26 and 27 being positioned toward the 6 o'clock position when viewed from side elevation of FIG. 5.

Figure 6A:
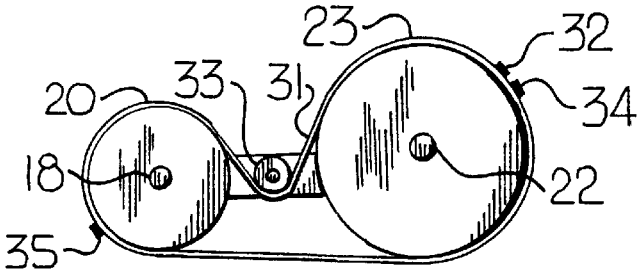
FIG. 6*a* is an expanded view of a preferred conversion mechanism of the present invention comprising a deflection pulley for use with exercise motions having a relatively large degree of rotation.
Figure 6B:
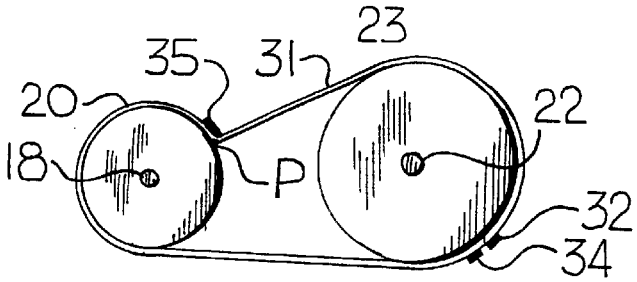
FIG. 6*b* is an expanded view of a conversion mechanism in which the tangency of the belt has been broken during an exercise motions having a relatively large degree of rotation.
Figure 7:
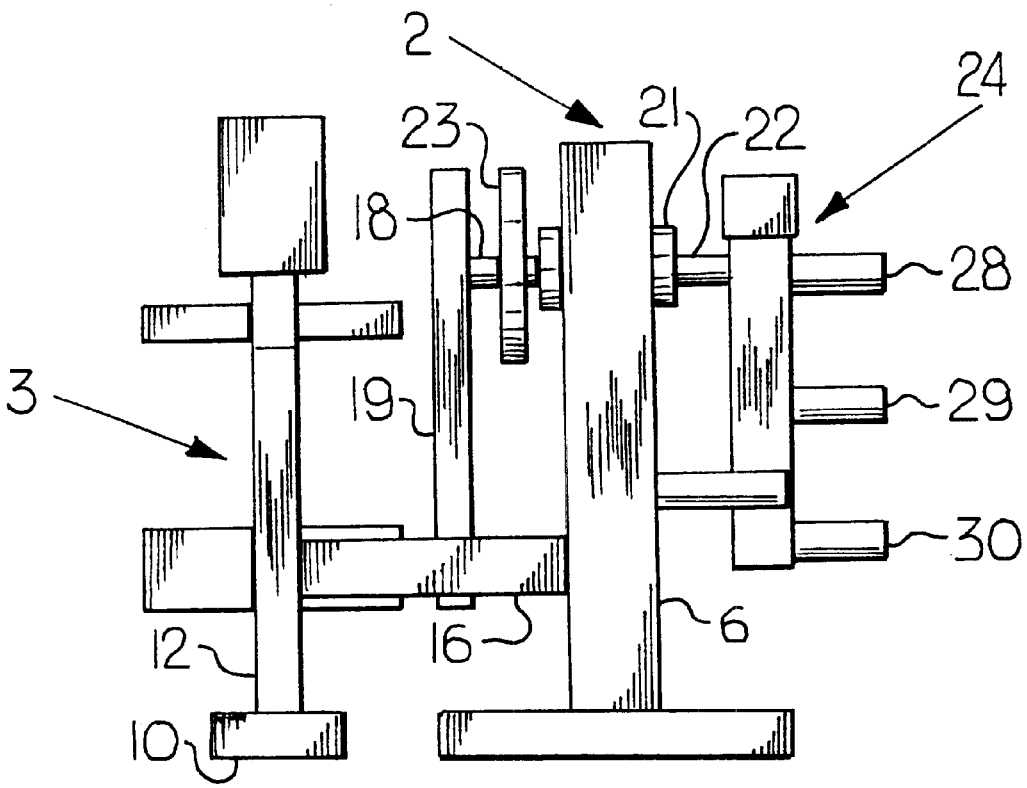
FIG. 7 is a rear elevation view of the embodiment of FIG. 3.

A belt 31 is preferably attached at one end to second beltwheel 23 by means of a first connector or tab 32 that pinches the first end of belt 31 to second beltwheel 23. Belt 31 is preferably then deflected around an idler pulley 33, wrapped around first beltwheel 20 and subsequently attached at its other end to second beltwheel 23 by means of a second connector or tab 34 that pinches the second end of belt 31 to second beltwheel 23. A third tab 35 preferably pinches belt 31 to first beltwheel 20 at a location that does not cause the belt 31 to break its tangency with first beltwheel 20 whenever an exercise motion is performed. The deflection of belt 31 around idler pulley 33 is significant in any exercise motion having a relatively large degree of rotation. Otherwise the belt 31 would break tangency from the first beltwheel 20 and likely fail (that is, tear at the point where tangency is broken). An example of the breaking of tangency of belt 31 with first beltwheel 20 at point P in the absence of deflection of belt 31 is illustrated in FIG. 6*b*.

The relative sizes (that is, diameters) of first beltwheel 20 and second beltwheel 23 are preferably chosen to assure that second shaft 22 and attached torque assembly 24 rotate no more than approximately 90 degrees (more preferably, no more than approximately 70 degrees) when first shaft 18 is rotated by the displacement of exercise member 19 during an average exercise motion. In the preferred embodiment of FIGS. 3 through 9, which depict a leg extension exercise device, the size ratio (first beltwheel 20 to second beltwheel 23) is preferably 2:1. This ratio results in a preferred maximum degree of rotation of second shaft 22 (and, thereby, torque assembly 24) of approximately 70 degrees, given a maximum degree of the exercise motion approaching 140 degrees.

Although the present invention has been described in detail in connection with the above examples, it is to be understood that such detail is solely for that purpose and that variations can be made by those skilled in the art without departing from the spirit of the invention except as it may be limited by the following claims.

What is claimed is:

1. An exercise device for generating a plurality of resistance curves comprising: a support frame, a first shaft rotatably supported on the support frame; a user interface member in operative connection with the first shaft which, when displaced by a user, causes the first shaft to rotate; a torque arm assembly comprising at least an upper torque arm and a lower torque arm connected to the first shaft at different fixed angular orientations, each torque arm comprising a support mechanism to support at least one weight member thereon; the upper torque arm being connected to the first shaft at an angular orientation so that when a weight member is placed on the upper torque arm, the upper torque arm generates a minimum resistance force at the end of the rotation of the first shaft when the user interface member is displaced by the user, the lower torque arm being connected to the first shaft at an angular orientation so that when a weight member is placed on the lower torque arm, the lower torque arm generates a minimum resistance force at the beginning of the rotation of the first shaft when the user interface member is displaced by the user, wherein a conversion mechanism operatively connects the first shaft and a second shaft rotatably connected to the user interface member, and wherein the conversion mechanism operatively connects the first and second shafts to control the relative rates of rotation of the first and second shafts such that the resistance force generated by the torque arm assembly cannot result in a negative force.

2. The exercise device of claim 1 wherein the torque arm assembly comprises at least a third torque arm, the third torque arm being connected to the first shaft at an angular orientation different from the upper torque arm and the lower torque arm.

3. The exercise device of claim 1 wherein an independent weight member supported on each of the torque arms is linearly positionable on each of the plurality of torque arms.

4. The exercise device of claim 1 wherein the support mechanism of each torque arm is adapted to removably support at least one weight member thereon.

5. The exercise device of claim 1 wherein the conversion mechanism is a beltwheel assembly.

6. An exercise device for generating a plurality of resistance curves comprising: a support frame, a first shaft rotatably supported on the support frame; a user interface member in operative connection the first shaft which, when displaced by a user, causes the first shaft to rotate; a torque arm assembly comprising an upper torque arm, a middle torque arm and a lower torque arm connected to the first shaft at different fixed angular orientation, each torque arm comprising a support mechanism to support at least one weight member thereon; the upper torque arm being connected to the first shaft at an angular orientation such that when a weight member is placed on the upper torque arm, the upper torque arm generates a minimum resistance force at the end of the rotation of the first shaft when the user interface member is displaced by the user, the middle torque arm being connected to the first shaft at an angular orientation such that when a weight member is placed on the middle torque arm, the middle torque arm generates a maximum resistance force at some point in the middle of the rotation of the first shaft when the user interface member is displaced by the user; the lower torque arm being connected to the first shaft at an angular orientation such that when a weight member is placed an the lower torque arm, the lower torque arm generates a minimum resistance force at the beginning of the rotation of the first shaft when the user interface member is displaced by the user, wherein a conversion mechanism operatively connects the first shaft and a second shaft rotatably connected to the user interface member, and wherein the conversion mechanism operatively connects the first and second shafts to control the relative rates of rotation of the first and second shafts such that the resistance force generated by the torque arm assembly cannot result in a negative resistance force.

7. The exercise device of claim 6 wherein the torque arm assembly comprises at least a fourth torque arm, the fourth torque arm being connected to the first shaft at an angular orientation different from the upper torque arm, the middle torque and the lower torque arm.

8. The exercise device of claim 6 wherein an independent weight member supported on each of the torque arms is linearly positionable on each of the plurality of torque arms.

9. The exercise device of claim 6 wherein the support mechanism of each torque arm is adapted to removably support at least one weight member thereon.

10. The exercise device of claim 6 wherein the conversion mechanism is a beltwheel assembly.

* * * * *

UNITED STATES PATENT AND TRADEMARK OFFICE

CERTIFICATE OF CORRECTION

PATENT NO. : 6,364,815 B1
DATED : April 2, 2002
INVENTOR(S) : Thomas G. Lapcevic It is certified that error appears in the above-identified patent and that said Letters Patent is hereby corrected as shown below:

Column 5,
Line 58, after "during" delete "an".

Column 8,
Line 15, after "connection" insert -- with --.

Signed and Sealed this

Thirty-first Day of December, 2002

JAMES E. ROGAN
*Director of the United States Patent and Trademark Office*